US006152639A

United States Patent [19]

Hsu

[11] Patent Number: 6,152,639

[45] Date of Patent: Nov. 28, 2000

[54] STRUCTURE ALLOWING FREE MOVEMENT OF A CABLE OF AN ELECTRIC TOOL

[75] Inventor: Hung-Ming Hsu, Yunlin Hsien, Taiwan

[73] Assignee: Mobiletron Electronics Co., Ltd., Taichung Hsien, Taiwan

[21] Appl. No.: 09/030,546

[22] Filed: Feb. 26, 1998

[51] Int. Cl.[7] ..... H01R 13/56

[52] U.S. Cl. ..... 403/116; 403/164; 403/344; 408/241 R; 439/6; 439/446

[58] Field of Search ..... 403/112, 113, 403/116, 164, 165, 344, 128, 150; 173/217; 81/177.4, 177.7, 177.75, 177.85; 174/135, 99 R; 439/455, 369, 6, 8, 13, 446; 408/241 R

[56] References Cited

U.S. PATENT DOCUMENTS

| | | | |
|---|---|---|---|
| 1,646,869 | 10/1927 | Orndorf | 439/6 |
| 2,594,242 | 4/1952 | Wilson | 439/6 X |
| 3,091,484 | 5/1963 | Laupot | 439/6 X |
| 3,141,251 | 7/1964 | Olson et al. | 174/135 X |
| 3,204,990 | 9/1965 | Blakely | 439/6 X |
| 4,719,314 | 1/1988 | Nothnagel et al. | 439/446 X |
| 4,779,687 | 10/1988 | Schreiber et al. | 173/170 |
| 5,735,707 | 4/1998 | O'Groske et al. | 439/446 |
| 5,810,525 | 9/1998 | Ector, Sr. | 408/241 R |
| 5,813,805 | 9/1998 | Kopras | 408/241 R |
| 5,902,080 | 5/1999 | Kopras | 409/182 |

*Primary Examiner*—Terry Lee Melius
*Assistant Examiner*—David E. Bochna
*Attorney, Agent, or Firm*—A & J

[57] ABSTRACT

The disclosure defined by this invention describes a structure which allows free movement of a cable of an electric tool. The structure is installed at the end of the handle of the electric tool and generally includes a seat cover, a cable clamping tube, and a cable tail stop. The seat cover includes a connecting chamber connected to the cable clamping tube. The cable is passed through the cable tail stop which passes through the inner and outer spaces of the handle. Hence, the cable may turn relative to the electric tool at any bending angle and the relative position between the cable and the electric tool may be easily arranged. Furthermore, the cable will not be easily damaged.

4 Claims, 3 Drawing Sheets

STRUCTURE ALLOWING FREE MOVEMENT OF A CABLE OF AN ELECTRIC TOOL

BACKGROUND OF THE INVENTION

1. Field of the Invention

The present invention relates to an electric tool, and more particularly to a structure which allows free movement of a cable of an electric tool.

2. Description of the Prior Art

In conventional electric tools, the cable is often led out from an opening formed in the distal end of the handle. Since electric tools have high outputs and high electric power consumption, the cables of electric tools are generally thick and heavy in order to bear the electric load. Cables of electric tools are therefore unlike ordinary thin electric wires or cables which are easily bendable. Cables of electric tools are difficult to wind around the electric tools when not in use, and they make the electric tools very bulky in appearance. As they project from the body of the electric tool, they are likely to be hit upon by workers passing by. Besides, they may be inadvertently dragged down and damaged when the electric tools are placed near the edge of tables.

Furthermore, since the cable bends at a fixed inclined angle from the handle, it is difficult to stand a gun-shaped electric tool on a table, unless it is battery operated or wireless. Gun-shaped electric tools can only be placed on their sides on the tables when not in use. It is therefore not convenient.

SUMMARY OF THE INVENTION

The present invention relates to an electric tool, and more particularly to a structure which allows free movement of a cable of an electric tool.

A primary object of the present invention is to provide a structure which allows free movement of the cable of an electric tool. According to the present invention, the structure comprises a seat cover, a cable clamping tube, and a cable tail stop. The structure is installed at the end of the handle of the electric tool where the cable is led out. The seat cover includes a connecting chamber connected to the cable clamping tube. The cable is passed through the cable tail stop which passes through the inner and outer spaces of the handle. The cable tail stop is enclosed by the cable clamping tube which may turn in the connecting chamber of the seat cover. Hence, the cable may turn relative to the electric tool at any bending angle and the relative position between the cable and the electric tool may be easily arranged. And besides, the cable will not be easily damaged.

Another object of the present invention is to provide a structure which allows free movement of the cable of an electric tool, in which the seat cover has a very wide bottom plane surface. That part of the body of the seat cover which corresponds to the relatively heavy end of the handle is higher than that part of the seat cover which corresponds to the relatively light end of the handle. When the structure is coupled to the electric tool, the electric tool as a whole may be stood on a table surface by means of the bottom plane surface of the seat cover, with the center of gravity of the electric tool falling inside the range of the seat cover.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
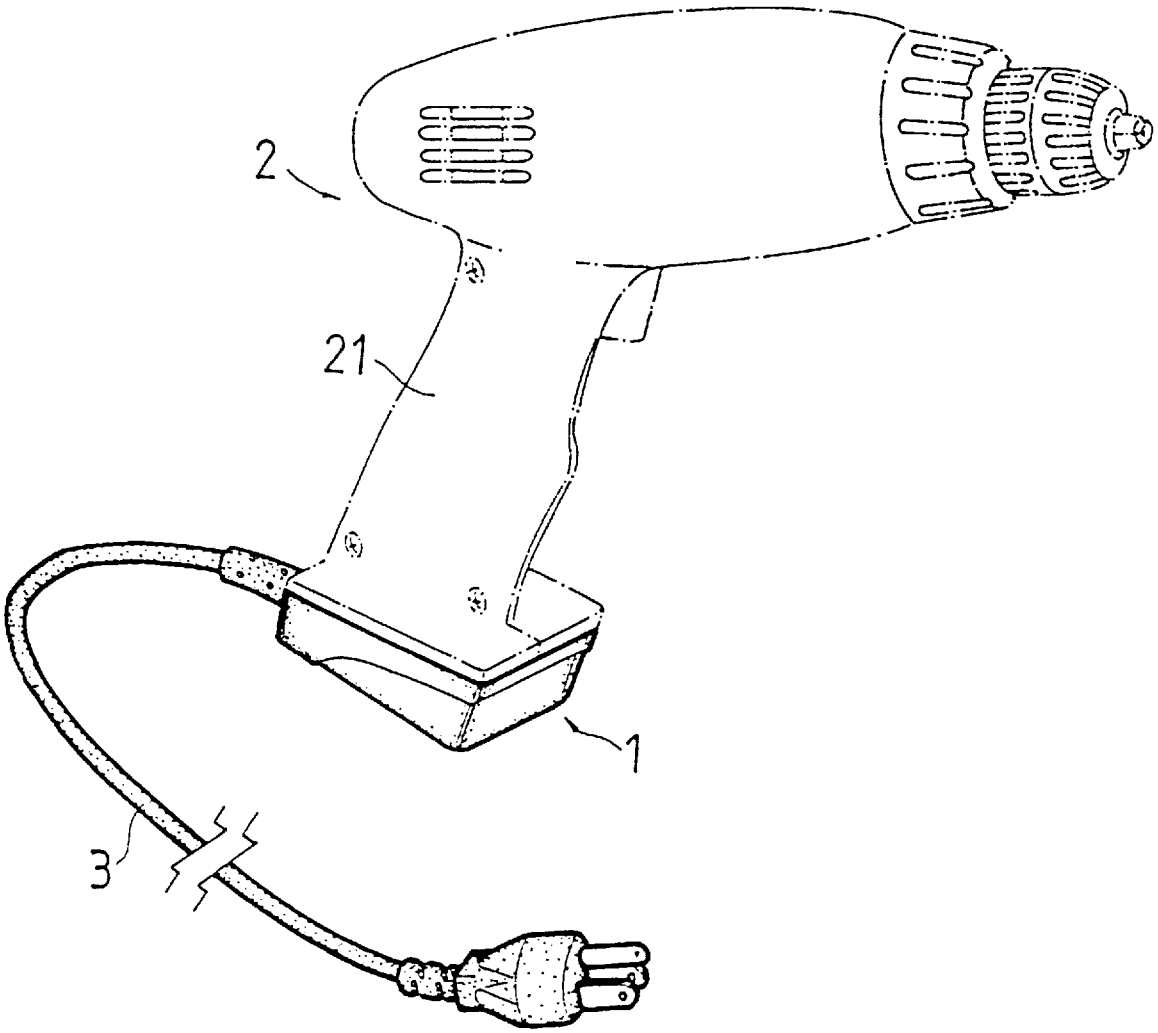
FIG. 1 is a perspective view showing the structure of the present invention coupled to an electric tool.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
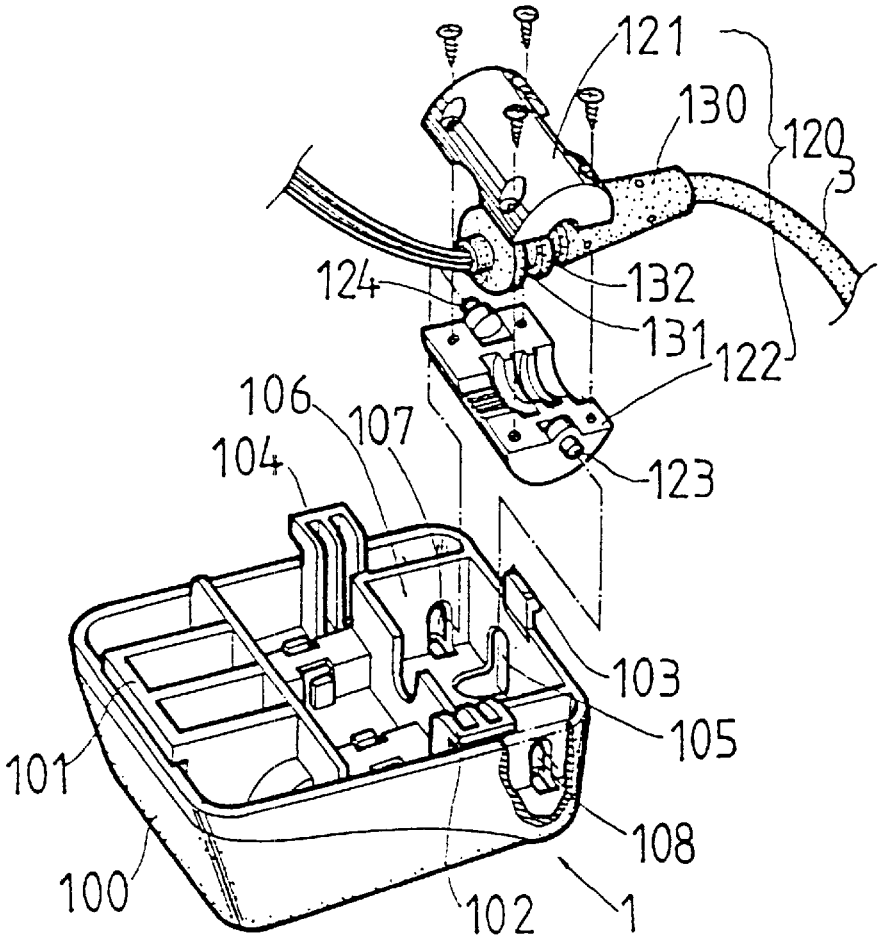
FIG. 2 is a perspective exploded view of the present invention.
Figure 3:
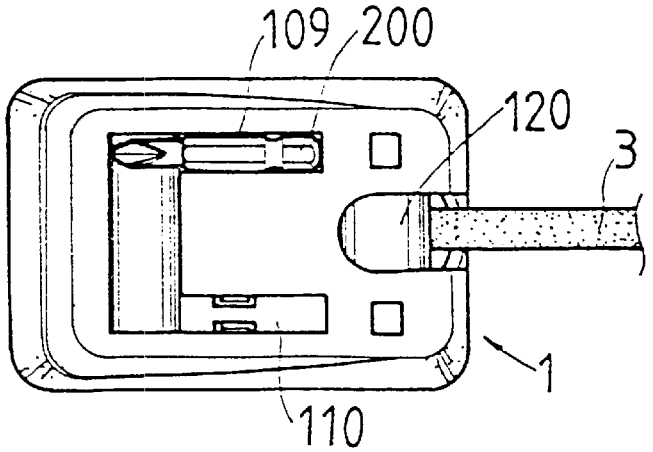
FIG. 3 is a bottom view of the present invention.

FIG. 1 shows a perspective view of the structure 1 according to the present invention coupled to an electric tool 2. It can be seen from FIG. 1 that the structure 1 is mounted at the end of a handle 21 of the electric tool 2 at where a cable 3 extends therefrom. The detailed structure of the present invention is described with reference to FIG. 2. The present invention essentially comprises a seat cover 100, a cable clamping tube 120, and a cable tail stop 130. The seat cover 100 has a plurality of fastening hooks 101, 102, 103, and 104 projecting from its edges towards the walls of an inner cavity at the end of the handle 21 to insertably engage the wall of the inner cavity of the handle 21. One corner of the seat cover 100 is formed with a substantially L-shaped through slot 105. The seat cover 100 further forms a cable connecting chamber 106 in its cavity near the through slot 105. The two side walls of the chamber 106 which are parallel to the length of the through slot 105 are respectively provided with connecting holes 107, 108. The outer periphery of the cable tail stop 30 is formed with a plurality of retaining rings 131, 132, . . . , and the cable 3 is passed through the tail stop 130. The cable clamping tube 120 may comprise an upper tubular portion 121 and a lower tubular portion 122 to enclose part of the tail stop 130 inside a cavity of the cable clamping tube 120, such that the retaining rings 131, 132 are fixedly retained in the cavity of the cable clamping tube 120. The body of the cable clamping tube 120 and the tail stop 130 are arranged in a T-shaped configuration. Furthermore, two pins 123, 124 are provided at the center of the two ends of the body of the cable clamping tube

120 to insert into the above-mentioned connecting holes 107, 108. That end of the cable 3 with the plug extends through the through slot 105, while the other end thereof is passed through the tail stop 130 into the cavity of the handle 21 of the electric tool 2 (see FIG. 1), so that the cable clamping tube 120 enclosing the cable 3 may turn in the connecting chamber 106. Hence, the bending angle between the cable 3 and the electric tool 2 may be movably change. The seat cover 100 is configured to have a very wide bottom plane surface, and that part of the body of the seat cover 100 which corresponds to the relatively heavy end of the handle 21 of the electric tool 2 is configured to be higher than the relatively light end of the handle 21. The bottom housing portion of the seat cover 100 may further be blown into the space inside the seat cover so that the bottom surface thereof forms a plurality of tool clamp grooves 109, 110, as shown in FIG. 4, to allow placement and easy removal or storage of tool bits 200 (such as bits of screwdrivers).

Figure 4:
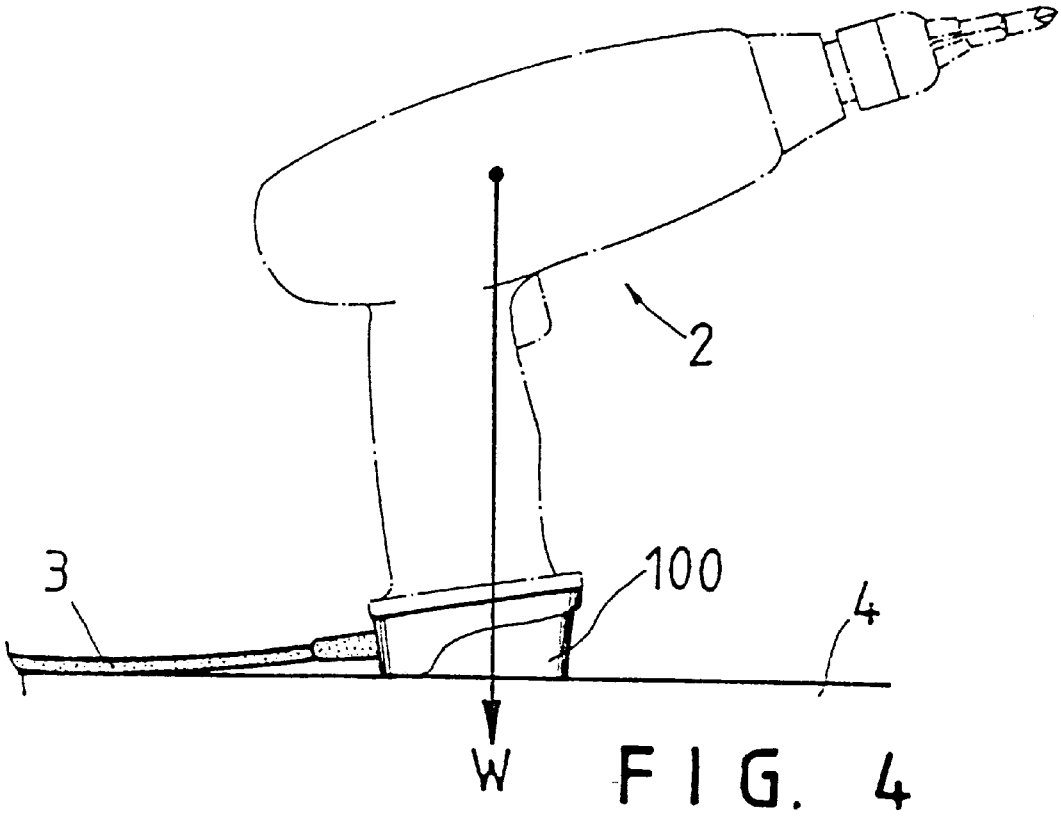
FIG. 4 is a schematic view showing the electric tool with the structure of the present invention standing on a table surface.

In use, referring to FIG. 4, since the two ends of the seat cover 100 have suitable heights and inclination corresponding to the distribution of the weight of the electric tool 2, and since the seat cover 100 has a very wide bottom plane surface, the seat cover 100 may be coupled to a gun-shaped electric tool to allow the cable of the electric tool to be movably bent against a table surface 4 during operation. And besides, the electric tool 2 may be stood on the table surface 4 by means of the bottom plane surface of the seat cover 100 such that the center of gravity W of the electric tool 2 falls within the range of the seat cover 100. Thus, the electric tool 2 may be firmly stood on the table surface 4 temporarily during operation.

Figure 5:
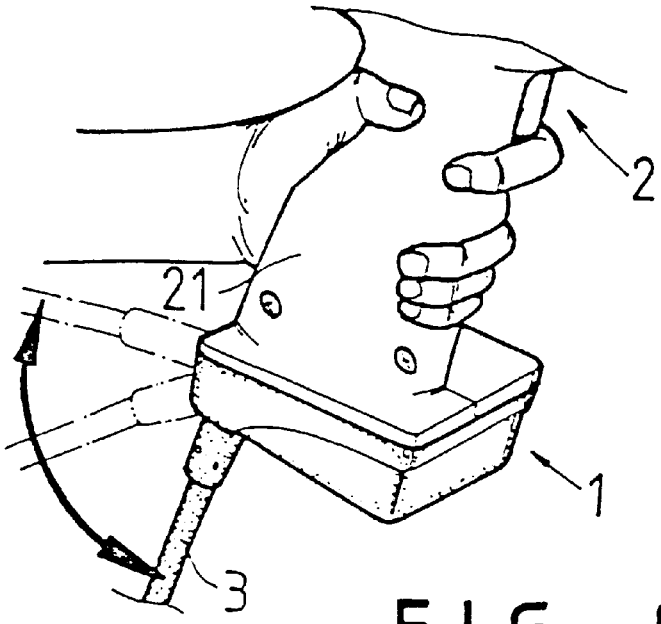
FIG. 5 is a schematic view showing the movement of the cable of the electric tool provided with the structure of the present invention.

Referring to FIG. 5, when operating the electric tool 2, the user grips the handle 21 to lift the electric tool 2. Since the structure of the present invention allows change in the bending angles of the cable 3 relative to the electric tool 2, the cable 3 will naturally swing about a suitable angle due to its own weight to match the changes in working angles. In addition, since the bending angles between the cable 3 and the handle 21 are changeable, the cable 3 may be wound or retrieved from a most suitable angle to reduce the bulkiness of the entire electric tool 2 caused by the cable 3.

In summary, the structure according to the present invention allows a free bending angle between the cable and the electric tool so that the relative position of the cable and the electric tool may be easily arranged. The cable may not be easily damaged at where it is connected to the electric tool. The present invention eliminates the drawbacks in the prior art.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A structure allowing free movement of a cable of an electric tool, said structure being installed at the end of a handle of said electric tool and comprising:

a seat cover, a cable clamping tube, and a cable tail stop, wherein said seat cover has a plurality of fastening hooks projecting from edges of said seat cover towards side walls of an inner cavity at the end of said handle to engage said side walls of said inner cavity of said handle, and a substantially L-shaped through slot formed at a corner thereof, said seat cover further forming a cable connecting chamber in a cavity thereof near said through slot, said connecting chamber having two side walls which are parallel to the length of said through slot and which are respectively provided with connecting holes; and said cable tail stop has an outer periphery formed with a plurality of retaining rings which are passed through said cable tail stop, with part of said cable tail stop enclosed in a cavity of said cable clamping tube such that said retaining rings are firmly retained by inner walls of said cable clamping tube, body of said cable clamping tube and said cable tail stop being arranged in a T-shape configuration, a center of two ends of said body of said cable clamping tube having two pins respectively extending therefrom for insertion into said connecting holes, one end of said cable extending through said through slot, with the other end extending into said cavity of said handle of said electric tool.

2. The structure as defined in claim 1, wherein said cable clamping tube is comprised of an upper tubular portion and a lower tubular portion.

3. The structure as defined in claim 1, wherein said seat cover is made to have a very wide bottom plane surface and has a first portion made to be higher than other portion of said seat cover, said first portion being fastened to a relatively heavy end of said handle of said electric tool, so that said electric tool may stand on a table surface by using said bottom plane surface of said seat cover, with center of gravity of said electric tool falling within range of said seat cover.

4. The structure as defined in claim 1 or 3, wherein said seat cover has a portion of a bottom housing thereof blown into a space inside said seat cover to form a plurality of tool bit clamp grooves on a bottom surface of said seat cover.

* * * * *